United States Patent [19]

Sisson

[11] 4,290,525

[45] Sep. 22, 1981

[54] AUTOMATIC COUNT AND IDENTIFICATION CARRIER FOR REFUNDABLE CANS

[76] Inventor: Kimberley R. Sisson, 2300 Kent Blvd., N.E., Grand Rapids, Mich. 49503

[21] Appl. No.: 75,889

[22] Filed: Sep. 17, 1979

[51] Int. Cl.[3] ..... B65D 5/36; B65D 5/46; B65D 33/02; B65D 33/06

[52] U.S. Cl. ..... 206/427; 206/459; 229/54 C; 229/55

[58] Field of Search ..... 206/428, 459, 427; 229/54 C, 55, 52 BC

[56] References Cited

U.S. PATENT DOCUMENTS

| | | | |
|---|---|---|---|
| 2,652,972 | 9/1953 | Davis | 229/55 |
| 3,006,532 | 10/1961 | Fine | 229/54 C |
| 3,367,487 | 2/1968 | Dwyer, Jr. | 206/459 |
| 3,537,455 | 11/1970 | Skyles et al. | 229/55 |
| 3,829,002 | 8/1974 | Kleinhaut | 229/54 C |
| 3,933,303 | 1/1976 | Kirby, Jr. | 229/52 BC |

*Primary Examiner*—William T. Dixson, Jr.

*Attorney, Agent, or Firm*—Price, Heneveld, Huizenga & Cooper

[57] ABSTRACT

A carrier for empty beverage containers is disclosed constructed to cause the containers to be arranged on their sides in horizontal tiers with each tier accommodating a predetermined number of containers. At least one wall panel of the carrier is transparent to permit inspection of the contents and has indicia providing an automatic count of the number of containers in the carrier.

1 Claim, 3 Drawing Figures

AUTOMATIC COUNT AND IDENTIFICATION CARRIER FOR REFUNDABLE CANS

BACKGROUND OF THE INVENTION

In a number of areas, legislation has been passed requiring deposits be made on the containers for all types of beverages. This necessitates return of the containers, if the deposit is to be recovered. The return of the empty containers has proven to be burdensome for a number of reasons. In many cases the initial packaging for the containers is of a type which is destroyed or so heavily damaged that it is practically useless to hold the empty containers for the purpose of return. Since the original packaging is lost or useless, the containers are frequently returned to the store in a paper shopping sack. This is inconvenient for everybody concerned, including the store. In the case of the store, the containers must be removed from the sack so they can be identified and counted. Further, it is important to the store that they be able to inspect each of every container to determine that the containers are in fact those which are properly returnable for refund. Particularly, is this a problem in border areas between jurisdictions which require returnable containers and those which do not.

BRIEF DESCRIPTION OF THE INVENTION

The invention provides a light weight carrier specifically designed for empty containers. The carrier is sized and shaped to accept one type of container and to permit the containers to be arranged in horizontal tiers, one above the other, with at least one transparent panel to permit the containers to be inspected, identified and counted from the exterior of the carrier. The carrier provides a means of automatically displaying the count of the container content of the carrier so that the facility to which the empty containers are returned can both identify the containers and quickly know the quantity without having to actually count the individual containers. Once the containers have been identified and counted, the carrier can be emptied and reused.

DESCRIPTION OF THE PREFERRED EMBODIMENT

Figure 1:
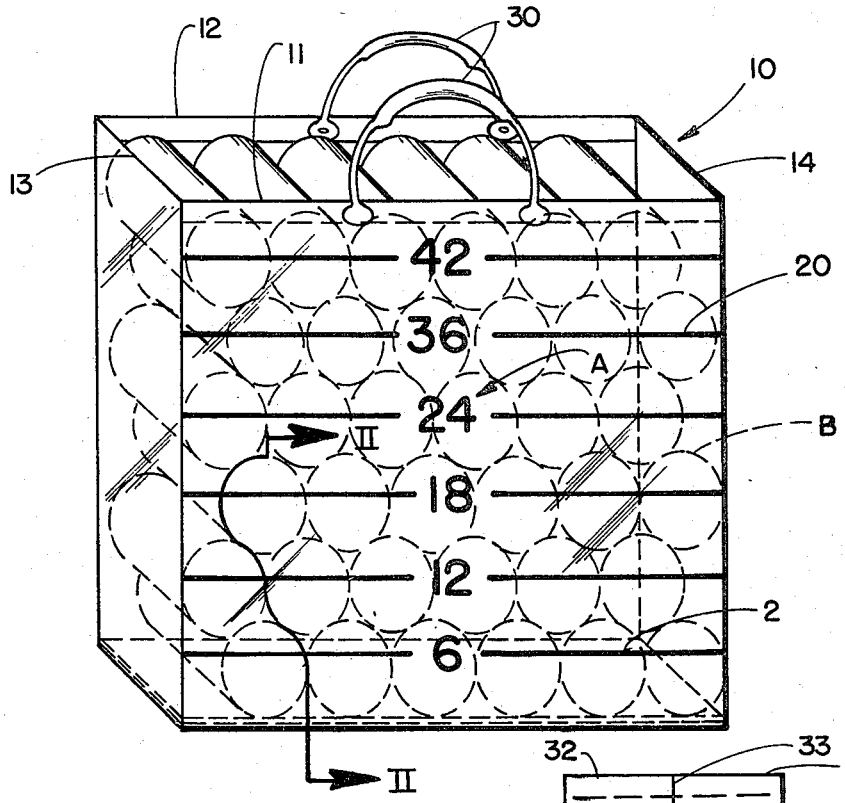
FIG. 1 is an oblique view of a carrier constructed according to this invention partially filled with empty containers.
Figure 2:
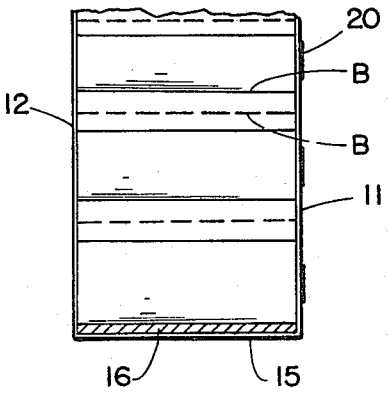
FIG. 2 is a fragmentary sectional view taken along the plane II—II of FIG. 1.

The numeral 10 indicates a carrier having a front panel 11, a back panel 12 and a pair of end panels 13 and 14. The carrier also has a bottom panel 15. Preferably, within the container and resting on the bottom panel 15 is a stiffener panel 16. The stiffener panel 16 is designed to provide a rigid or semi-rigid, flat bottom surface for the interior of the carrier. As such it may be fabricated from any of a number of suitable materials including pressed board, cardboard or plastic sheet material. Preferably, it is coated or encased in a moisture impervious jacket to make it resistant to liquids which may be spilled inadvertently into the interior of the carrier. This type of spillage is to be expected because the so-called empties are not always entirely drained with the result that a portion of their content may be discharged into the carrier.

The side, front, back and bottom panels are preferably formed of a plastic sheet material such as polymethacrylate, polyethylene or polypropylene. The thickness of the sheet of film will be governed in part by the nature of the containers to be placed in the carrier. A three mil film is quite adequate for cans but a five mil film is more practical if glass containers are involved. The container can be formed from flat sheet material which is wrapped into tubular shape to form the back, front and side panels of the container and the end of the sheet folded and bonded together to form the bottom panel. In this case, a vertical seam is formed where the edges of the sheet are joined either in one of the vertical panels or at one of the corners between the vertical panels. It is also possible to form the body of the carrier from an extruded seamless tube of the plastic material, thus eliminating the vertical seam. However, once again, one end has to be folded and bonded together to form the bottom panel 15. Both methods of making the basic container are well known and do not form a part of this invention.

The cross-sectional size and shape of the carrier is governed by the design of the containers to be placed in it. The carrier is particularly suited to use with beverage cans and is illustrated as used in this environment. These cans are light and are of uniform size and shape for a large variety of products. In this case the carrier is sized so that the cans will just conveniently fit lengthwise between the front and back panels. The length of the carrier is slightly greater than a multiple of the diameter of one of the cans. The carrier is in effect squared out to this size and shape by seating the stiffener 16 in the bottom since this provides a rigid support for the walls of the carrier.

The material selected for the body of the container must be transparent because it is essential to this invention that at least one panel and preferably two panels be transparent. Preferably these should be the front and back panels 11 and 12. The transparency permits the contents of the carrier to be visually inspected without removal of the contents. The transparency is necessary to permit the ends of the containers to be inspected to determine that they are, in fact, returnable containers for which a refund is due. Unless this is possible, the receiving facility may be induced to pay a refund for containers which it later discovers were not refundable. For such containers it cannot recover the refund from the beverage distributor. In those areas where returnables are required, the containers, particularly metal ones, are normally marked with some type of identification on at least one end to distinguish returnables from non-returnables. For this purpose, it is not only preferable but in some areas may be essential that both the front and the back panel be transparent so that the containers can be inspected from either end, assuming that they have been randomly arranged, so far as their end-to-end relationship is concerned.

At least one of the transparent panels is provided with indicia which displays an automatic count of the contents of the carrier. A preferable indicia for this purpose consists of a series of parallel lines 20 spaced at intervals which correspond to the vertical distance between the center lines of the containers when they are arranged within the carrier. Each line represents a given number of containers. In addition, the accumulative count can be displayed as by the numbers A associated with each line. Thus, in the particular design of the carrier illustrated in FIG. 1, six containers B are arranged in each tier. Thus, the lines 20 have the numbers 6 through 42 to inform the receiving station of the total content of the carrier. This display could appear on the end panels as well or as a substitute for the front panel as illustrated. However, a front panel display is considered preferable because it permits both inspection of the empty containers and the count without requiring the user to rotate the carrier to obtain all of the information.

Figure 3:
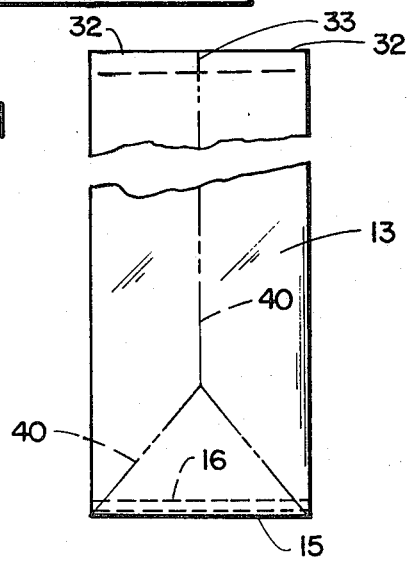
FIG. 3 is a broken, end view of the invention.

A pair of handles 30 are provided to facilitate carrying. To strengthen the carrier, reinforcing strips 31 are bonded to or enclosed in the plastic at the top edges of the front and back panels. The handles are secured to the body of the carrier preferably by fasteners which pass through the strips 31. Similar strips 32 can be provided at the top of each end panel but these should either be separated or treated to hinge at the center of the panel as indicated at 33 (FIG. 3).

While it is possible to design the carrier for use with various types of containers, to achieve the true purpose and benefits of the invention, it is necessary that a carrier be limited to one particular size and type of container. Thus, the carrier is particularly suitable for use with cans and this is illustrated as its preferred construction. Cans are light, thus involving little weight even when a large number of them are placed in a single carrier. Also cans for numerous types of beverages are uniform in size. Further, the packages in which cans are initially received such as a six pack, eight pack or twelve pack are normally such that the package has to be torn open or otherwise destroyed in order to remove the contents. Many are sold connected only by a thin, plastic strip or wrapped in transparent film. Thus, the initial package in which the beverage is purchased is useless as a means of either storing or returning the empty containers. If the invention is to be used for glass containers, then either the size of the carrier must be reduced to limit the total content, or the strength of the plastic material forming the walls and the bottom must be increased to account for the increased weight. Further, in the case of glass containers, the carrier should not be of a size which makes its use inconvenient for many people because of its weight.

It is intended that the carriers will be folded flat as initially manufactured, shipped and sold. The buyer will then unfold and erect the carrier. The carrier is provided with fold-lines 40 (FIG. 3) at the time of manufacture. To facilitate folding, the stiffener 16 may first be pivoted against the inside face of either the front or back panel and then the carrier folded about it. This provides a compact package for both initial shipment and sale and subsequently for storage when not in use. When the purchaser erects the carrier, seating the stiffener 16 in the bottom of the container will immediately provide it with the desired cross-sectional geometrical shape.

It is intended that the user will keep the carrier for repeated use with its contents being discharged after the deposit return has been determined. To this end, the stiffener panel 16 should be removable so that the interior of the carrier and the stiffener board itself can be washed to remove content which has been spilled from any of the so-called empty containers. This is important because most beverages contain materials which form gummy or sticky residues from the liquid which is evaporated. It is also for this purpose that the board should be made impervious to liquids.

The use of the handles, stiffeners at the top of the front and back panels and of making the carrier foldable are not part of this invention except and to the extent they are combined with the other concepts herein disclosed.

It will be recognized that the panels forming the walls of the carrier other than those on which the indicia A and the lines 20 appear can either remain transparent or can be printed to be opaque or to display some type of decorative printing to make the unit more attractive.

Having described the preferred embodiment of the invention, it will be recognized that modifications may be made without departing from the principle of the invention. Such modifications are to be considered as included in the hereinafter appended claims unless these claims by their language expressly state otherwise.

The embodiments of the invention in which an exclusive property or privilege is claimed are defined as follows:

1. A reuseable carrier for transporting empty metal beverage containers of a uniform size and shape, said carrier having a generally flat base of a size and shape such that its length is slightly greater than a multiple of the diameter of one of the containers to be transported; a front panel, a rear panel and a pair of end panels, said front and rear panels being spaced apart just sufficiently to permit one of the beverage containers to be positioned lengthwise between them, said base, front panel, rear panel and end panels being formed of a liquid impervious and washable material; said end panels being spaced apart sufficiently to permit a plurality of the containers to be placed in side-by-side relationship lengthwise of the carrier; handle means for supporting said carrier; one of said front and rear panels being transparent; a plurality of vertically spaced lines on said one panel, said lines being spaced apart a distance equal to the vertical center to center spacing of the ends of the containers when they are arranged on their sides in tiers with one tier resting on the tier beneath; indicia displayed at each line indicating the cumulative number of containers in the carrier when the tier of containers corresponding to the line is full to provide an automatic count of the container content of the carrier; and a rigid stiffener panel removably disposed on said base, said rigid stiffener panel being formed from a liquid impervious washable material, said end panels defining fold-lines positioned so that the front, rear and end panels may be folded around said stiffener panel.

* * * * *